US005457927A

United States Patent [19]

Pellock et al.

[11] Patent Number: 5,457,927

[45] Date of Patent: Oct. 17, 1995

[54] TRUSS

[75] Inventors: Michael A. Pellock, Edwardsville, Ill.; Larry R. Daudet, Highland, Ind.

[73] Assignee: MiTek Holdings, Inc., Wilmington, Del.

[21] Appl. No.: 92,238

[22] Filed: Jul. 15, 1993

[51] Int. Cl.[6] ..... E04C 3/02

[52] U.S. Cl. ..... 52/633; 52/639; 52/693; 52/634; 52/731.7; 403/295

[58] Field of Search ..... 52/90.1, 90.2, 52/633, 634, 639, 643, 641, 693, 696, 702, 704, 731.1, 731.3; 403/400, 401, 402, 295, 232.1

[56] References Cited

U.S. PATENT DOCUMENTS

| | | | |
|---|---|---|---|
| 1,351,614 | 8/1920 | Brown | 52/634 |
| 1,747,362 | 2/1930 | Graveley . | |
| 2,477,163 | 7/1949 | Barnett | 20/94 |
| 2,638,637 | 5/1953 | Kump, Jr. | 20/2 |
| 2,768,434 | 12/1956 | Taylor | 29/526 |
| 2,770,846 | 11/1956 | Findleton | 20/5 |
| 3,137,098 | 6/1964 | Elia et al. | 52/639 |
| 3,656,270 | 4/1972 | Phillips | 52/693 |
| 3,760,550 | 9/1973 | Mueller et al. | 52/641 |
| 3,785,108 | 1/1974 | Satchell | 52/645 |
| 3,845,594 | 11/1974 | Butts et al. | 52/634 |
| 4,201,021 | 5/1980 | Aldag et al. | 52/93 |
| 4,329,824 | 5/1982 | Lowe | 52/634 |
| 4,435,940 | 3/1984 | Davenport et al. | 52/641 |
| 4,616,453 | 10/1986 | Sheppard, Jr. et al. | 52/693 |
| 4,773,192 | 9/1988 | Andrews | 403/295 |
| 4,878,323 | 11/1989 | Nelson | 52/92 |
| 4,974,387 | 12/1990 | Dufour | 52/639 |
| 4,986,052 | 1/1991 | Nelson | 52/745 |
| 5,010,709 | 4/1991 | Paz | 52/658 |
| 5,156,484 | 10/1992 | Allen | 403/295 |

FOREIGN PATENT DOCUMENTS

| | | | |
|---|---|---|---|
| 6057878 | 3/1994 | Japan | 52/634 |
| 0418608 | 2/1967 | Switzerland | 52/639 |
| 2062060 | 5/1981 | United Kingdom | E04C 3/07 |
| 2247033 | 2/1992 | United Kingdom | 52/634 |

*Primary Examiner*—Carl D. Friedman
*Assistant Examiner*—Winnie S. Yip
*Attorney, Agent, or Firm*—Senninger, Powers, Leavitt & Roedel

[57] ABSTRACT

A truss fabricated of cold rolled sheet metal structural members having chord members, web members, and connectors for joints thereof, of such construction as to enable fabrication of the truss with the chord members lying flat on a fabrication table and further of such construction as to allow a plurality of trusses to be stacked flatwise one on another for storage and delivery.

36 Claims, 9 Drawing Sheets

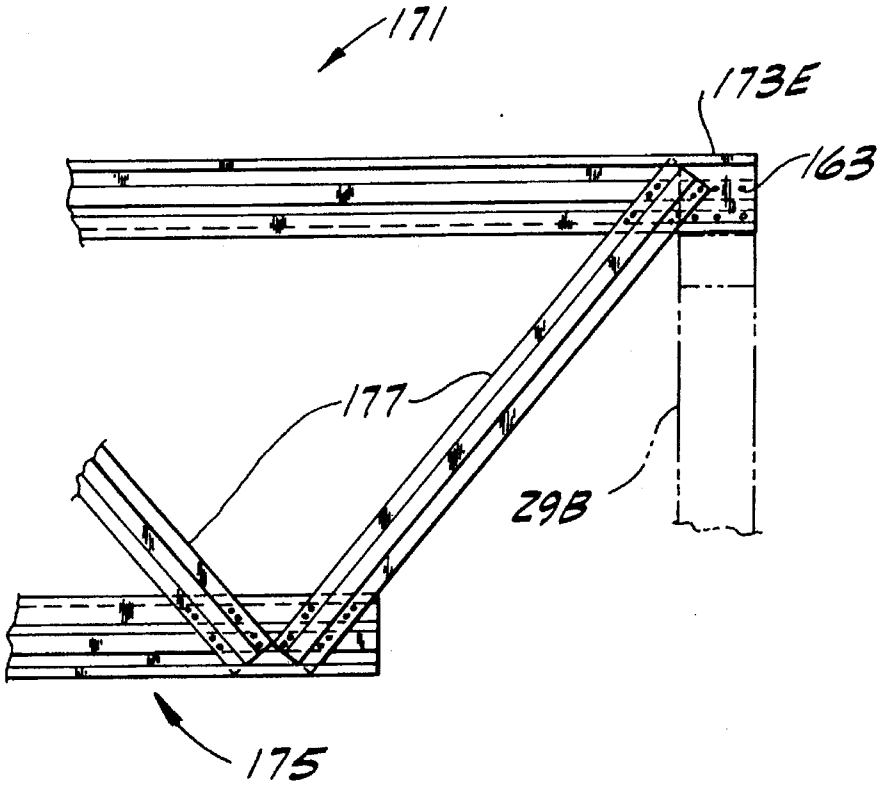
FIG. 15
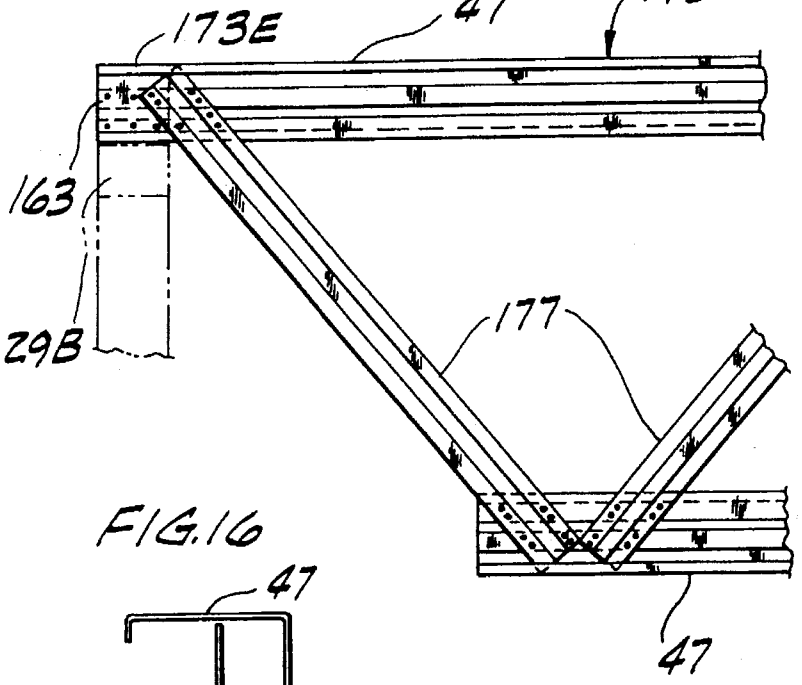
FIG. 16
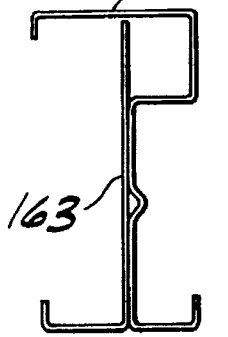

TRUSS

BRIEF SUMMARY OF THE INVENTION

This invention relates to trusses, and more particularly to trusses fabricated of cold rolled sheet metal structural members.

Among the several objects of the invention may be noted the provision of a truss fabricated of cold rolled sheet metal structural members having an upper chord, a lower chord and web members extending between the chords, wherein the upper chord and the lower chord comprise chord members which are adapted to lie flat for facilitating the fabrication of the truss; the provision of such a truss wherein the upper chord comprises two chord members and the lower chord comprises at least one chord member, with two of the upper chord members inclined upwardly from the heels or lower outer ends of the truss, and with each of the upper and lower chord members being formed of sheet metal and having a cross-sectional shape that significantly reduces the effect of torsional buckling under dead load, reduces eccentricity at the joints, and reduces lateral and torsional buckling from live loads during and after erection of the truss; the provision of a truss construction that allows for a plurality of trusses to be stacked flatwise one upon another and bundled for transportation and delivery in an efficient and safe manner without special spacer blocks or wasted space between trusses in the stack, similar to the manner and in bundles of comparable size to those in which present wood trusses may be stacked; the provision of such a construction for a truss which may be referred to as an "in plane" construction, allowing for easy and efficient fabrication of gable trusses (trusses with a peak such as king-post and scissors trusses), and parallel chord trusses (trusses with a top chord member extending substantially parallel to the bottom chord), and for easy and efficient attachment of sheathing or decking to the trusses as erected; the provision of such a truss which has a pleasing appearance, having a "clean look"; the provision of such a construction for a truss wherein the faces of the truss are free of fasteners (e.g. screws) for efficient stacking, safe handling and convenient attachment of dry wall and paneling to a side of the truss as erected; the provision of a truss construction in which areas most susceptible to damage and failure can be conveniently reinforced or stiffened to prevent such damage or failure during handling, erection and use of the truss; the provision of such a truss having an upper chord member with a relatively wide upper flange or head for enhanced support and surface area to facilitate attachment of sheathing or decking applied to the trusses as erected; the provision of such a truss adapted for fabrication on a fabrication table with fastening together of components of the truss by means of self-tapping sheet metal screws without penetration of the screws into the table; the provision of such a truss having web members which may be nested one in another to provide additional strength when needed; the provision of a lower chord member for such trusses which provides a relatively broad flat surface for ready attachment of ceiling materials comparable to attachment of interior ceilings to 2×4 wood chord members; the provision of such a construction for a truss which allows for the attachment of all truss components from one side of the truss; the provision of such a truss construction as allows for relatively simple and efficient factory manufacture of truss component parts in relatively few different cross-sectional shapes, pre-cut to standard lengths and with minimal scrap material, for final assembly in the field; and the provision of such a construction for a truss which allows most—and in many cases, all—opposite ends of its component members to be square cut, to reduce the time spent in measuring and cutting special angles for truss assembly.

In general, a truss of this invention comprises an upper chord, a lower chord and web members extending between chords. The upper chord comprises at least one elongate chord member formed of sheet metal with such a shape in cross-section as to have a web having first and second faces, a flange extending laterally outwardly from the first face of the web at a first of the longitudinal edges of the web, a formation integrally joined to the web at the second of the longitudinal edges of the web having a portion offset laterally outwardly from the web and a generally flat portion extending back over said second edge constituting a head for said elongate chord member. The head extends generally at right angles to the plane of the web, having portions on both sides of the plane of the web, and is adapted to serve as a support for means (e.g., sheathing) which is subsequently applied to the truss. The lower chord comprises at least one elongate chord member formed of sheet metal with the same shape in cross-section as the upper chord member. The upper chord member and the lower chord member are arranged with the head of the upper chord member up, with the head of the lower chord member down, and with the webs of the upper and lower chord members generally coplanar. The web members are constituted by elongate members formed of sheet metal, certain of said members being engaged flatwise at the ends thereof with faces of the webs of the upper and lower chord members and secured thereto.

The truss may have a triangular or other non-trapezoidal shape; thus it may be a gable truss, for example, such as frequently used in residential and agricultural applications.

Or it may have a trapezoidal shape; thus it may be a parallel chord truss wherein the upper and lower chords are parallel, such as frequently used for floor trusses and roof trusses in commercial buildings.

The invention also involves a chord member per se (either an upper or lower chord member), constituting a structural member with a shape in cross-section as specified above. It also involves a web member (such as interconnected between the upper and lower chords) constituted by an elongate member formed of sheet metal with such a shape in cross-section as to comprise a central channel having a web and flanges at opposite sides of the web, said central channel opening in one direction, and side channels on opposite sides of the central channel each opening oppositely to the central channel, each side channel having a web integrally joined to a respective flange of the central channel at the edge of that flange outward of the web of the central channel, and an outer flange spaced outwardly from the respective flange of the central channel, the webs of the side channels being generally coplanar. The web member may be of such shape in cross-section that one web member may be nested in another.

Other objects and features will be in part apparent and in part pointed out hereinafter.

BRIEF DESCRIPTION OF THE DRAWINGS

FIG. 15 is a view in side elevation, partly broken away, of a truss embodying the invention having parallel upper and lower chords with the upper chord projecting at both ends beyond the ends of the lower chord, this type of truss being referred to as an inverted parallel-chord truss;

FIG. 16 is a view of the left end of the upper chord of FIGS. 14 and 15; and

Corresponding reference characters indicate corresponding parts throughout the drawings.

DETAILED DESCRIPTION

Figure 1:
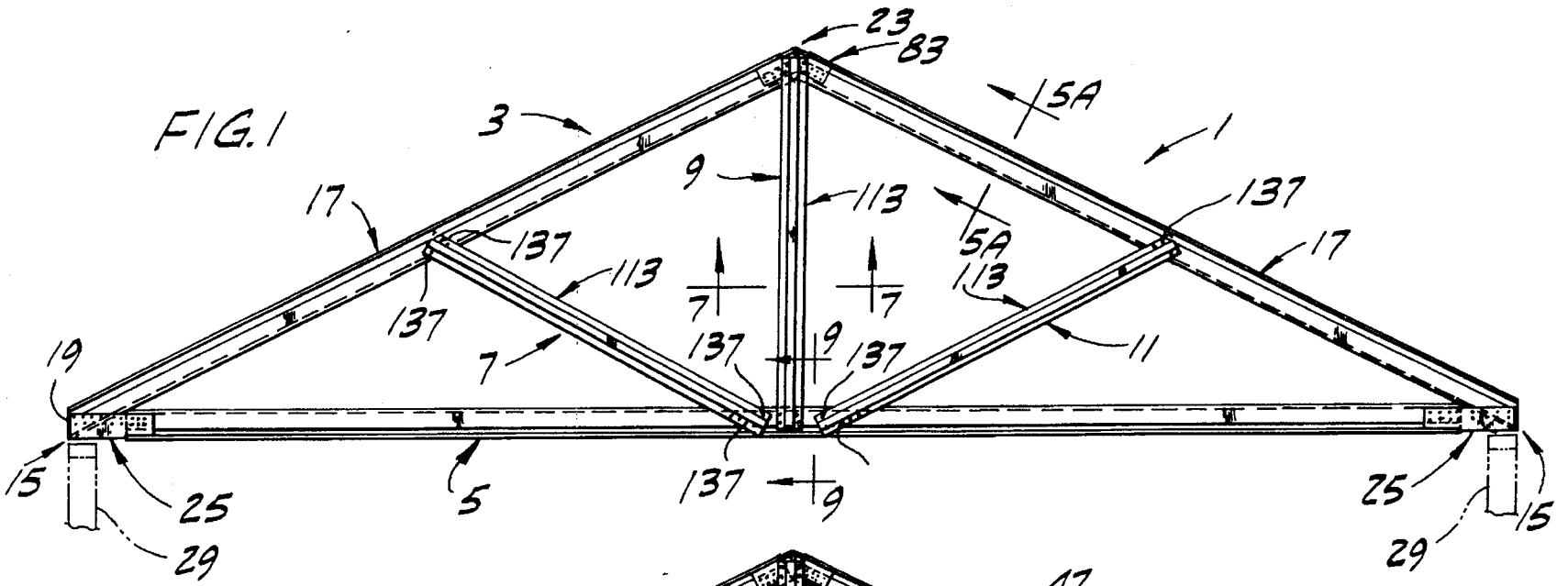
FIG. 1 is a view in side elevation of a king-post truss of this invention.

Referring first to FIG. 1, there is indicated at 1 a king post truss, of this invention comprising an upper chord designated in its entirety by the reference numeral 3, a lower chord 5, and web members 7, 9 and 11 extending between the chords and triangulating the space between the chords. The lower chord comprises an elongate straight single structural member having square-cut outer ends 13 (See FIG. 3) adjacent the lower outer ends or heels 15 of the truss. The upper chord comprises two elongate straight chord members each designated 17 and each having a first end 19 constituting its lower and outer end and a second square-cut end 21 (See FIG. 4) constituting its upper and peak end. In FIG. 1, the lower and outer end of each upper chord member is shown as being plumb cut, i.e., cut so as to be vertical when the truss is erected. It could be square cut (like end 21). The upper chord members 17 are arranged with their lower and outer ends 19 outward of and adjacent the outer ends 13 of the lower chord member 5 and inclined upwardly from the heels 15 of the truss to the peak 23 of the truss, the lower chord member constituting the base and the upper chord members constituting the legs of an isosceles triangle. As illustrated, the angle of inclination of the upper chord members with respect to the base is about 30° . Each upper chord member 17 is interconnected at each of its outer and lower ends 19 to the lower chords at the respective outer end of the lower chord by means designated 25 forming a respective heel 15 of the truss. The peak ends 21 of the upper chord members are located adjacent one another at the peak of the truss and are interconnected by means designated 27 (See FIG. 4) forming the peak of the truss. As shown, the truss bears at its heels on supporting structure such as indicated at 29, although it will be appreciated that the supporting structure may be moved inwardly from one or both heels of the truss to provide a cantilevered construction. Further, while the upper chord members are shown as having their lower and outer ends 19 generally flush with the outside of the supporting structure 29, it will be understood that they could extend beyond the supporting structure to provide overhangs.

Each upper chord member 17 is an elongate straight sheet metal member cut from stock formed by cold rolling sheet metal with such a shape in cross-section as to have a web 31 having first and second faces 33 and 35 and first and second longitudinal edges 37 and 39, a first relatively narrow flange 41 extending laterally outwardly from the first face 33 of the web at the first (the edge 37) of said longitudinal edges, and further to have a formation indicated in its entirety by the reference 43 integrally joined to the web at the second (the edge 39) of the longitudinal edges of the web. More particularly, this formation has a portion 45 offset laterally outwardly from said first face 33 of the web 31 and a generally flat reentrant portion 47 extending back over the second edge 39 of the web and spaced outwardly from said second edge constituting what may be referred to as a head for the elongate "sheet metal" member. The flange 41 is generally flat, extends out from the first face 33 of the web 31 generally at right angles to the web, and has a relatively narrow, generally flat reentrant lip 49 at its outer edge 51 generally at right angles thereto. The aforesaid formation 43 specifically comprises a flange 53 constituting a second flange on the web 31 extending laterally outwardly from the first face 33 of the web at the second longitudinal edge 39 of the web, a relatively narrow generally flat web constituting the aforesaid offset portion 45 offset laterally outwardly of the plane of the web 31 and extending from the outer edge 57 of the said second flange 53 in the direction away from the first flange 41 generally at right angles to the second flange 53. The head 47 extends laterally from the outer edge 59 of the narrow offset web 45, being integrally joined thereto at 57 and having a reentrant lip 61 at its free edge 63 extending generally at right angles thereto in the direction back toward the plane of the flange 53. The stock from which the chord members are cut to the desired length may be formed with webs 31 of different width, as dictated by the span of the truss and the loading on the truss. It may be cold rolled of 22, 20, 18, 16 or 14 gauge steel strip, for example, with the web 31 being 2¼ inches wide (FIG. 5A), 4¼ inches wide (FIG. 5B) or 6 inches wide (FIG. 5C), for example. The first and second flanges 41 and 53 of the chord member stack are generally equal in width (e.g. ¾ inch wide). The narrow offset web 45 is 1¼ inches wide, for example, and the head 47 is 1¾ inches wide, for example. The lips 49 and 61 are each ⅜ inch wide, for example. It will be observed that with the stated dimensions for the chord member stock the head 47 extends one inch beyond the plane of the web 31 in the direction away from the narrow web 45 (toward the left as viewed in FIG. 5A). The web 31 of the chord member stock may be formed with a stiffening rib 65 (FIG. 5A) or ribs 65 (FIGS. 5B and 5C) extending lengthwise thereof. It will be noted that the outside dimensions of the chord members as exemplified above approximate the finished dimensions of standard U.S. "2×4", "2×6" and "2×8" lumber sizes, i.e., 1¾"× 3½" (FIG. 5A), 1¾"×5½" (FIG. 5B) and 1¾"× 7¼" (FIG. 5C) thereby enabling the truss designer and construction worker to follow current practices and to readily substitute trusses of the present invention for standard wood trusses in many construction projects.

Figure 5A:
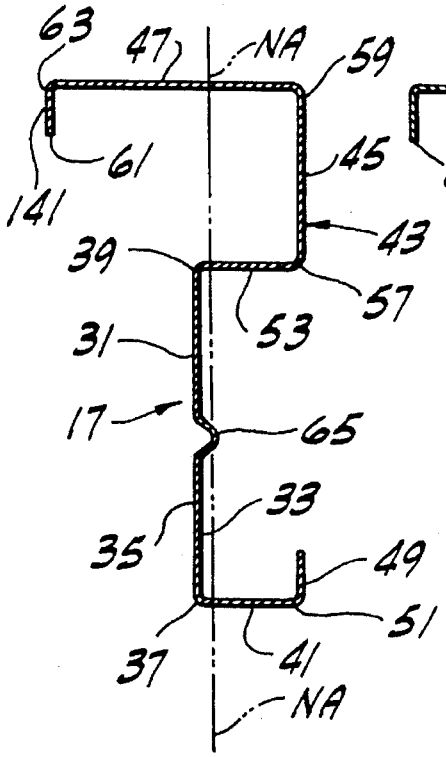
FIG. 5A is an enlarged cross-section on line 5A—5A of FIG. 1 showing the shape in cross-section of a chord member of the truss.
Figure 5B:
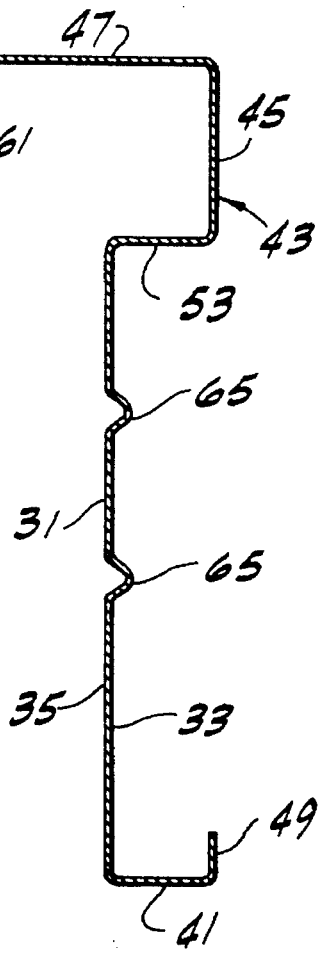
FIGS. 5B and 5C are view similar to FIG. 5A showing chord members of different sizes that may be used.
Figure 5C:
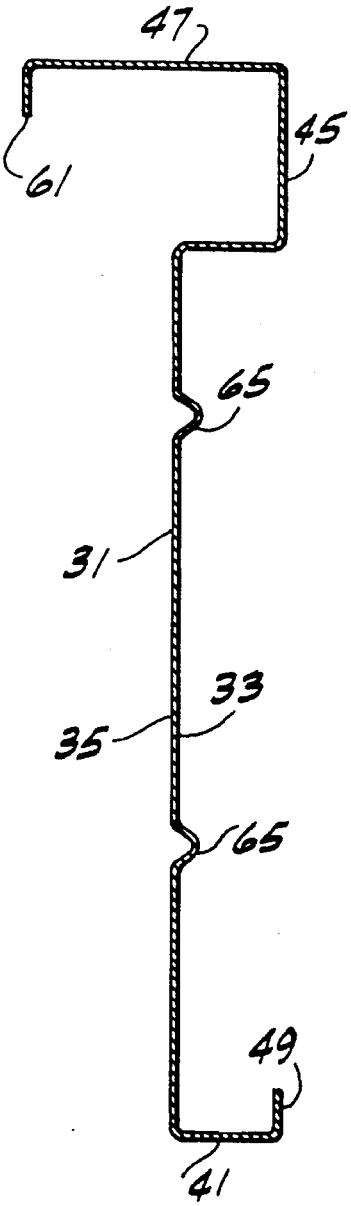

With the cross-section of the chord member 17 as shown in FIG. 5A, the chord member has a neutral axis generally parallel to and adjacent the face 33 of the web 31 of the chord member slightly offset from face 33 of the web, as indicated at NA in FIG. 5A. With this neutral axis so located, there is a significant reduction in the effect of torsional buckling under dead load, in eccentricity at the joints, and in lateral and torsional buckling from live loads which may occur during and after erection of the truss.

As shown, the lower chord 5 comprises a single straight elongate chord member cut from stock having the same shape in cross-section as the upper chord members 17 and the same reference numerals are applied to the web, etc. of the lower chord member as to the web etc. of the upper chord members. The upper chord members and the lower chord member are arranged with the heads 47 of the upper chord members up, with the heads 47 of the lower chord member down, and with the webs of the upper and lower chord members generally coplanar in a plane which becomes the vertical plane of the truss when it is erected, and with the first faces 33 of the webs 31 of the upper and lower chord members facing in one direction toward one side of the truss and the second faces 35 of the webs 31 of the upper and lower chords members facing in the opposite direction toward the other side of the truss.

Figure 3:
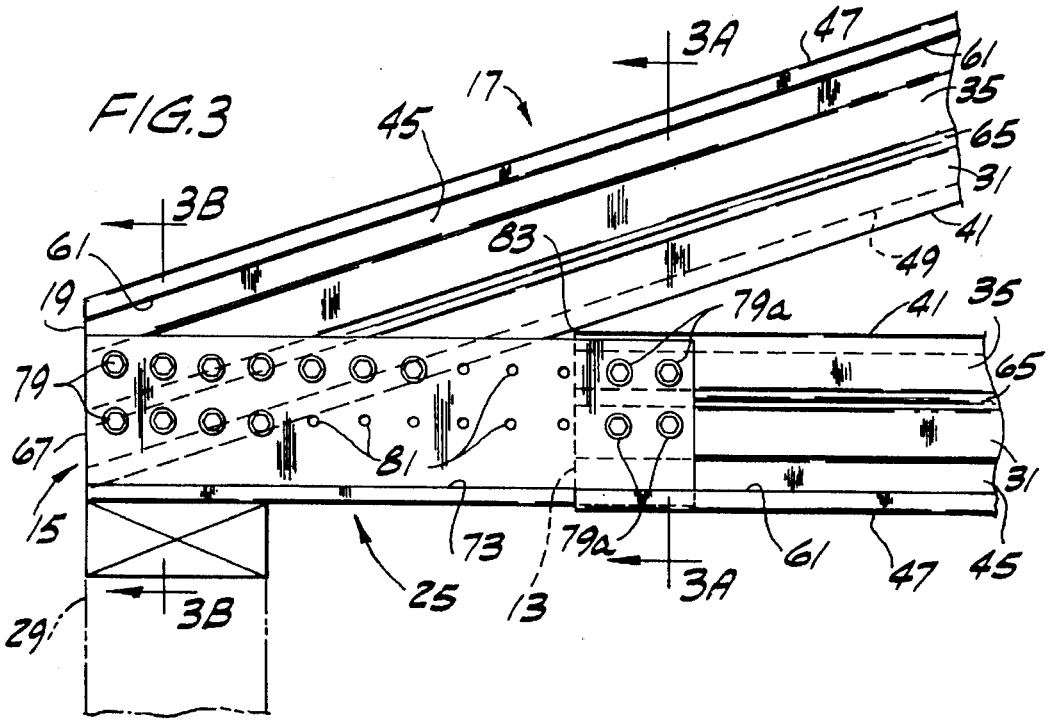
FIG. 3 is an enlarged fragment of FIG. 1 showing one of the heels of the truss.
Figure 3A:
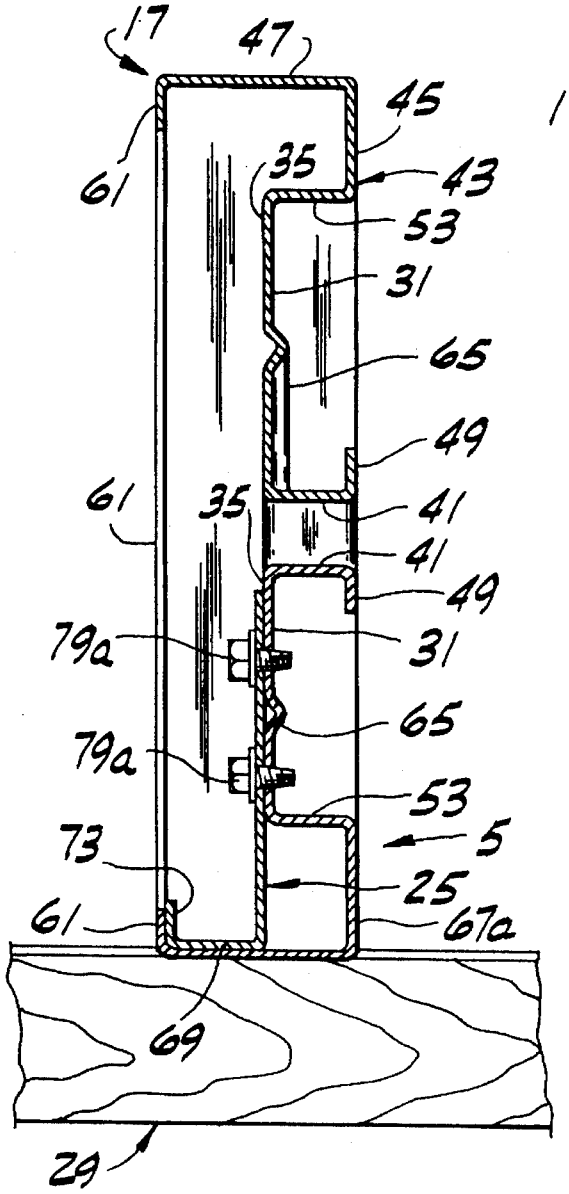
FIG. 3A and 3B are views in section on lines 3A—3A and 3B of FIG. 3 on a larger scale than FIG. 3.
Figure 3B:
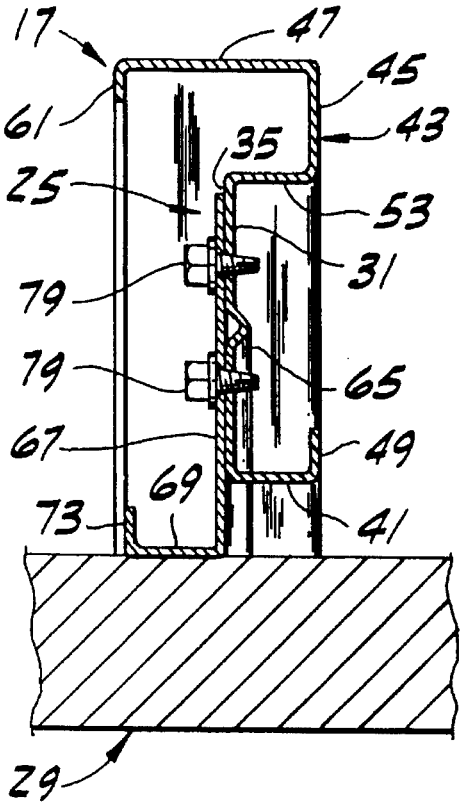

The means 25 interconnecting the upper chord members 17 and the lower chord 5 at each of the heels 15 of the truss comprises a connector and stiffener member constituted by rectangular sheet metal plate 67 engaged flatwise with the second face 35 of the web 31 of the respective upper chord member 17 and the second face 35 of the web 31 of the lower chord member 5 and fastened to these webs. More particularly, each of the plates 67 has an outwardly extending flange 69 for stiffening it at one of the long edges thereof indicated at 71. This flange 69 has a reentrant lip 73 at its free edge 75 extending generally at right angles to the flange in the direction toward the plane which intersects the other long edge 77 of the plate at right angles to the plate. (See FIG. 6). The plate 67 at each heel of the truss is fastened to the web 31 of the respective upper chord member 17 at the outer end of the respective upper chord member on the face 35 of the web 31 of the upper chord member by self-tapping screws 79, with the plate 67 extending inwardly from the upper chord member generally in line with the lower chord member 5, and fastened to the web 31 of the lower chord member on the face 35 of the lower chord member by self-tapping screws. Preferably, the plates 67 are supplied with a set of pre-formed (e.g. pre-punched) holes such indicated at 81 in FIG. 3 provided at appropriate locations in the plates as supplied (by pre-punching or pre-drilling) and the screws are inserted in appropriate holes of the set and turned to tap holes in the webs 31 and threaded in the tapped holes for secure fastening of the parts. In the assembly of the chord members and the plate 67 at each heel 15 of the truss, the lower chord member 5 has its respective square-cut end 13 located as shown in FIGS. 1 and 3 with the upper and lower chord members at the desired angle (e.g. 30° ) and the upper edge 83 of the square-cut end 13 of the lower chord member 5 (i.e. the end of the flange 41 of the lower chord member) contiguous to the flange 41 of the upper chord member 17, and with the webs 31 of the upper and lower chord members in the same plane (see FIGS. 3A and 3B). At each heel 15 of the truss, the respective connector/stiffener plate 67 is arranged with its flat face 67*a* engaging the face 35 of the upper chord member 17 and with the flange 69 of the plate extending outwardly in the direction away from the face 35 of the web 31 of the upper chord member 17. The plate 67 extends inwardly from adjacent the outer end of the upper chord member into overlapped relation for some distance with respect to the face 35 of the lower chord member 5. Screws such as specially indicated at 79*a* extend through holes (four holes as shown in FIG. 3) at the inner end of the plate 67 and are threaded (by self-tapping) in tapped holes in the web 31 of the lower chord member 5. The plate 67 is so dimensioned and the holes 81 are so located that the plate at each heel 15 of the truss extends down beyond the web 31 of the lower chord member 5 for engagement of the flange 69 of the plate with the inside of the head 47 of the lower chord member 5 and with the flange 67 extending in the direction away from the narrow offset web 45 and with the outside of the lip 73 on the flange 69 engaged with the inside of the lip 61 on the head 47 of the lower chord member. For the FIG. 1 truss with the web 31 of the chord member having the 2¼ inch web 31 of FIG. 5A and the chord member having the other dimensions specified above, the plate may be 3¼ inches wide, the flange 69 may be ⅞ wide, and the lip 73 may be made ⅜ inch wide, for example. The flange 69 bears on the supporting structure 29.

Figure 4:
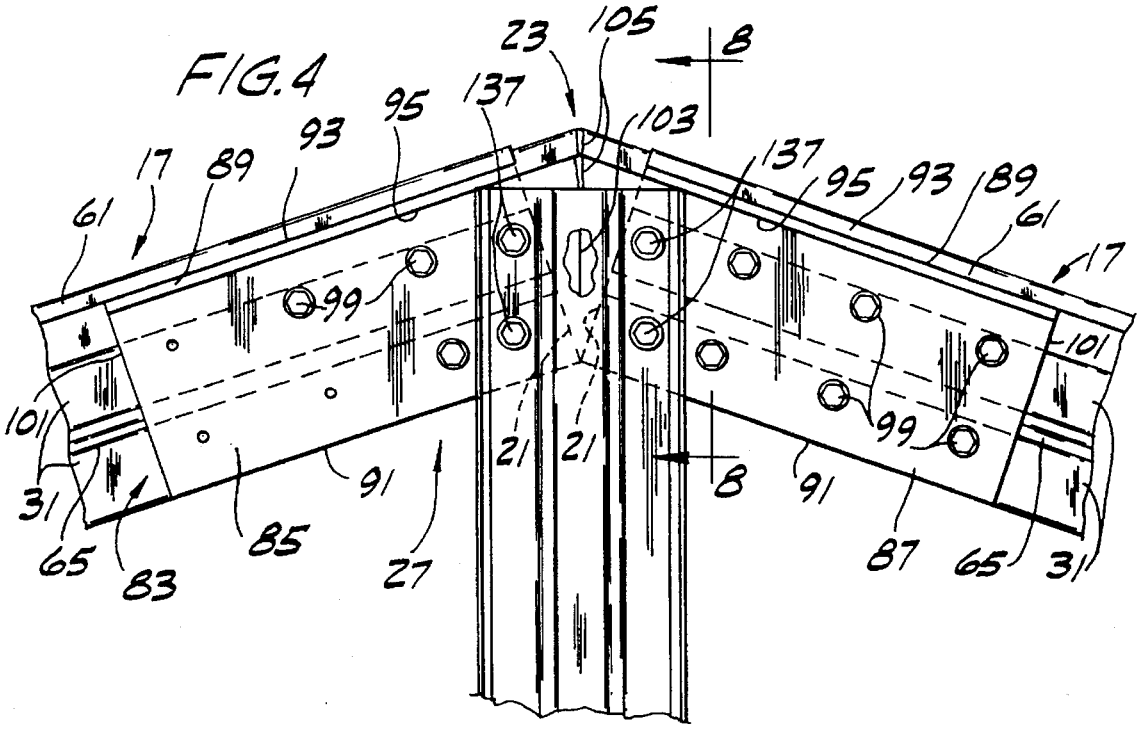
FIG. 4 is an enlarged fragment of FIG. 1 showing the peak of the truss.

The means 27 interconnecting the upper chord members 17 at the peak of the truss comprises a connector and stiffener member constituted by a flat sheet metal plate 83 having a first portion or branch 85 for attachment to the web 31 of one of the upper chord members adjacent the peak 23 of the truss and a second side portion or branch 87 for attachment to the web 31 of the other upper chord member adjacent the peak of the truss (see FIG. 4). Each side portion or branch 85, 87 has an upper edge 89 and a lower edge 91, these edges extending parallel to one another, with the edges 89 and 91 of branch 85 of the plate and edges 89 and 91 of branch 87 of the plate angled in correspondence with the inclination of the upper chord members. Each of the branches 85 and 87 has a flange 93 extending outwardly from the upper edge thereof generally at right angles to the plane of the plate 83. These flanges 93 are inclined downwardly and outwardly from the peak of the plate 83 (where the upper edges 89 of the branches of the plate meet) at an angle corresponding to the angle of inclination of the upper chord members 17 of the lines, e.g. angled 30° downward off horizontal. Each flange 93 has a reentrant lip 95 extending downwardly therefrom at its outer free edge 97 (like lip 73 of connector plate 67). Branch 85 of the plate 83 engages flatwise the face 35 of the web 31 of one of the upper chord members 17 (the member 17 at the left in FIGS. 1 and 4) and branch 87 of the plate 83 engages flatwise the face 35 of the web 31 of the other upper chord member (the member 17 at the right in FIGS. 1 and 4). The plate 83 is fastened to the stated webs 31 by self-tapping screws as indicated at 99. Holes for these screws may be provided in plate 83 as supplied for fabrication of the truss. The plate 83 is so dimensioned and so positioned as to extend up above the webs 31 of the upper chord members for engagement of the flanges 93 of the plate with the inside of the heads 47 of the upper chord members 17 and for engagement of the lips 95 on flanges 93 with the inside of lips 61 on the heads 47.

Figure 6:
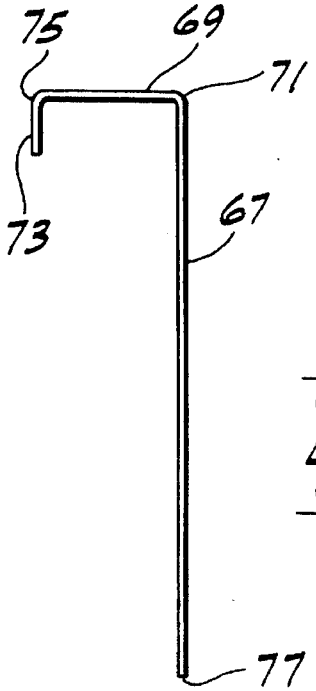
FIG. 6 is an enlarged cross-section of a connector and stiffener member used in the truss.
Figure 10:
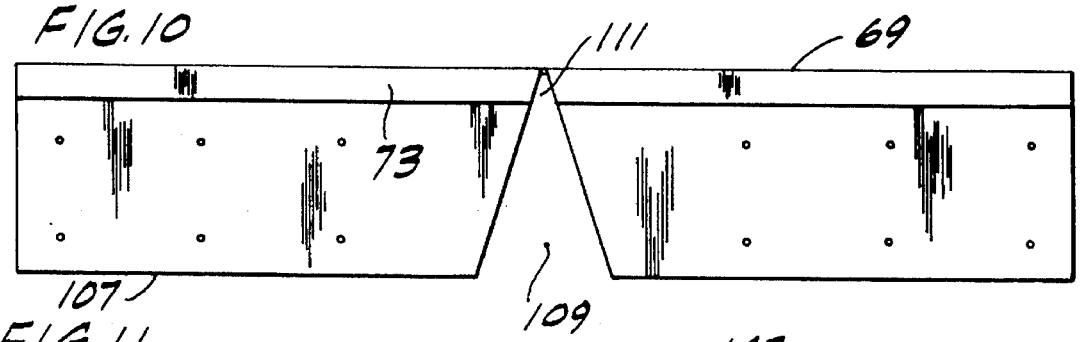
FIG. 10 is a view showing how a connector and stiffener member for the peak of the truss may be made.

The peak connector plate 83, which may be described as of chevron shape, may be formed by cutting sheet metal connector plate stock having the cross-section shown in FIG. 6 into pieces having the shape of the branches 85 and 87 of the plate 83, with a square-cut end edge for the outer end of each said branch and an angled edge 103 at the other end, and welding two of the pieces together at the angled edges as indicated at 105 in FIG. 4. Alternatively, the plate 83 may be formed from a rectangular blank 107 of stock (see FIG. 10) having the FIG. 6 connector plate cross-section by cutting a portion of inverted V-shape out of the plate portion 67 of this blank as indicated at 109 and cutting a portion of inverted V-shape out of the lip 73 of the blank as indicated at 111 with the apices of the V-shaped cuts at the inside face of the flange 69 of the blank, leaving the flange 69 intact, then bending the blank at flange 69 to bring the edges of the blank at the inverted V-shaped cutouts together and welding the two resultant angled branches 85 and 87 of the blank together at said edges.

Figure 7A:
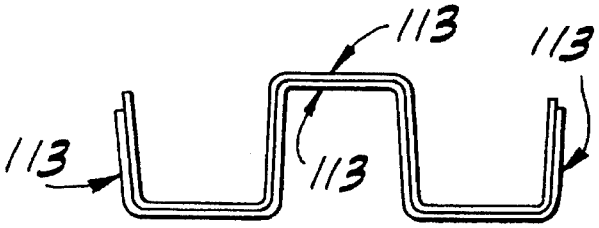
FIG. 7A is a view showing how two of the FIG. 7 web members may be nested.
Figure 7:
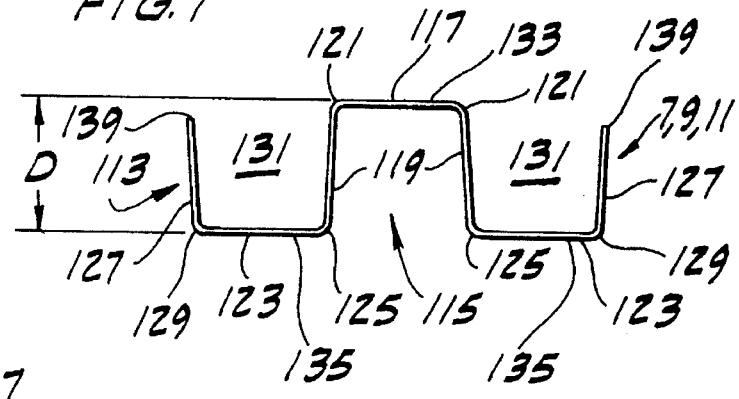
FIG. 7 is an enlarged cross-section on line 7—7 of FIG. 1 showing the shape in cross-section of a web member of the truss.
Figure 8:
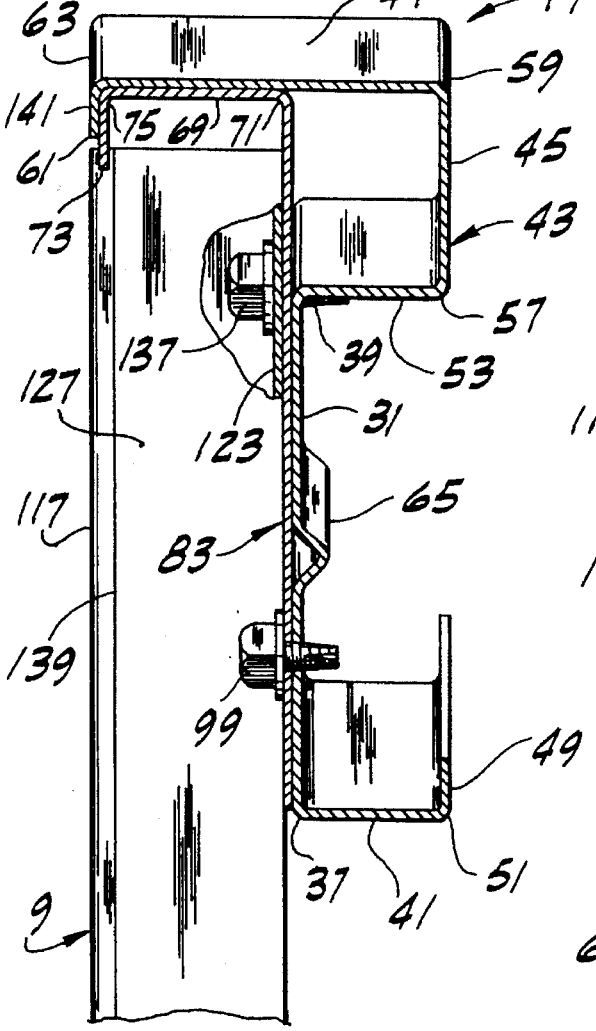
FIG. 8 is an enlarged section on line 8—8 of FIG. 4.
Figure 9:
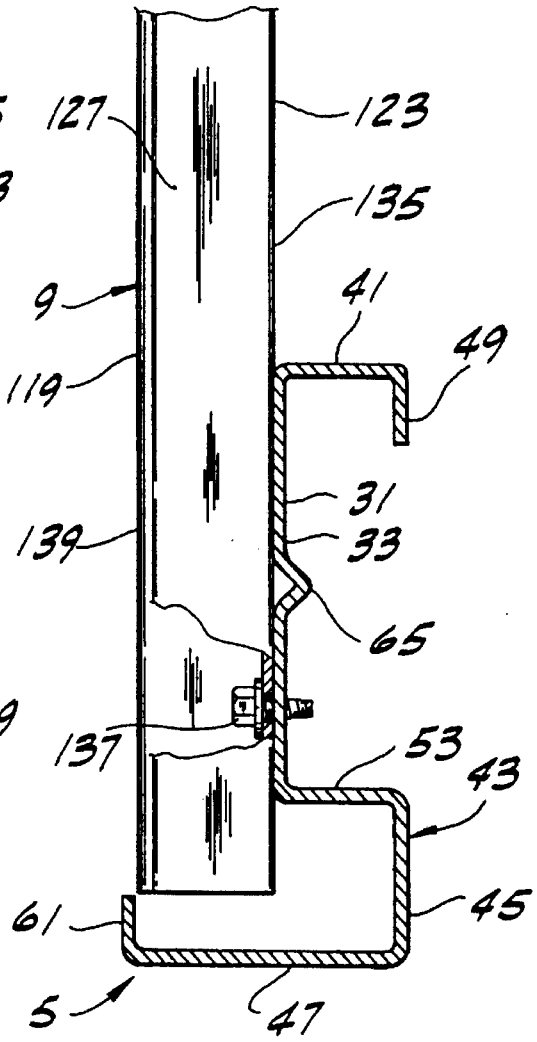
FIG. 9 is an enlarged section on line 9—9 of FIG. 1.

Each web member 7, 9, 11 of the truss is constituted by an elongate straight sheet metal member 113 cut from cold rolled sheet metal stock formed with such a shape in cross-section, as shown in FIG. 7, as to comprise a main channel 115 having a web 117, flanges 119 extending from the edges 121 of the web, lips 123 extending laterally outwardly from the outer edges 125 of the channel flanges 119 and reentrant flanges 127 extending back from the outer edges 129 of the lips 123. The cross section is thus generally of W-formation, having the main channel 115 as a vertical channel opening in one direction flanked by side channels each designated 131 opening in the opposite direction. The outside faces 133 of the web 117 and the outside faces 135 of lips 123 are generally flat, the outside faces 135 of the lips being generally coplanar in a plane parallel to the outside face 133 of the web with these two planes spaced a distance D (e.g. ¾ inch) preferably somewhat less than the spacing of the face 35 of the web 31 of each chord member from the plane of the outside of the lip 61 of each chord member, and in any event no greater than that spacing. The flanges 119, instead of being at right angles to the web 117, diverge at a slight angle (e.g. 7°) from the planes normal to the web through the end edges 121 of the web, and the flanges 127 are similarly divergent in the direction away from the plane of the lips 123, making it possible to nest one member 113 in another to provide a twice-as-strong web member 7, 9, 11. This nesting capability is illustrated in FIG. 7A.

The web member 7 extends between the upper chord member 17 at the left in FIG. 1 and the lower chord 5 generally from the midpoint of the left-hand upper chord member and a point just to the left of the center of length of the lower chord. The web member 7 is positioned with the outside faces 135 of its lips 123 flat against the face 35 of the web 31 of the left-hand upper chord 17 at the upper end of the web member and with the outside faces 135 of its lips 123 flat against the faces 35 of the web 31 of the lower chord 5 at the lower end of the web member, and is fastened to the chords by self-tapping screws 137 extending through the lips 123 and the webs of the chords. The web member 11 extends between the upper chord member 17 at the right in FIG. 1 and the lower chord generally from the midpoint of the right-hand upper chord member and a point just to the right of the center of length of the lower chord 5. The web member 11 is positioned with the outside faces 135 of its lips 123 flat against the face 35 of the web 31 of the right-hand upper chord 17 at the upper end of the web member and with the outside faces 135 of its lips 123 flat against the faces 35 of the web 31 of the lower chord 5 at the lower end of the web member, and is fastened to the chords by self-tapping screws 137 extending through the lips 123 and the webs of the chords. The web member 9 extends vertically between the peak 23 of the truss and the center of the lower chord 5, being positioned with the outside faces 135 of its lips 123 flat against the peak connector plate 83 at the upper end of the web member at the peak of the truss, and with the outside faces 135 of its lips 123 flat against the face 35 of the web 31 of the lower chord, being fastened to the plate 83 at its upper end by self-tapping screws 137 extending through lips 123, plate 83 and webs 31 of the two upper chord members adjacent the upper peak ends of the latter. It will be observed that, as to each of the web members 7, 9, 11, the face 133 of its web 117 and the free edges 139 of its flanges 127 lie substantially within the plane of the outside face 141 of the lips 61 on the heads 47 of the chord members except for the web member 9 at the peak of the truss where, on account of the plate 83 being interposed between the web member 9 and the faces 35 of the webs 31 of the upper chord members 17, the face 133 of web 117 lies somewhat close to the plane of the outside faces of lips 61 but does not break said plane. The importance of this is that a plurality of trusses may be stacked flat one on another with the lips 61 of the chord members 5 and 17 of one truss flat against the outside of the narrow offset webs 45 of the chords of another.

Figure 2:
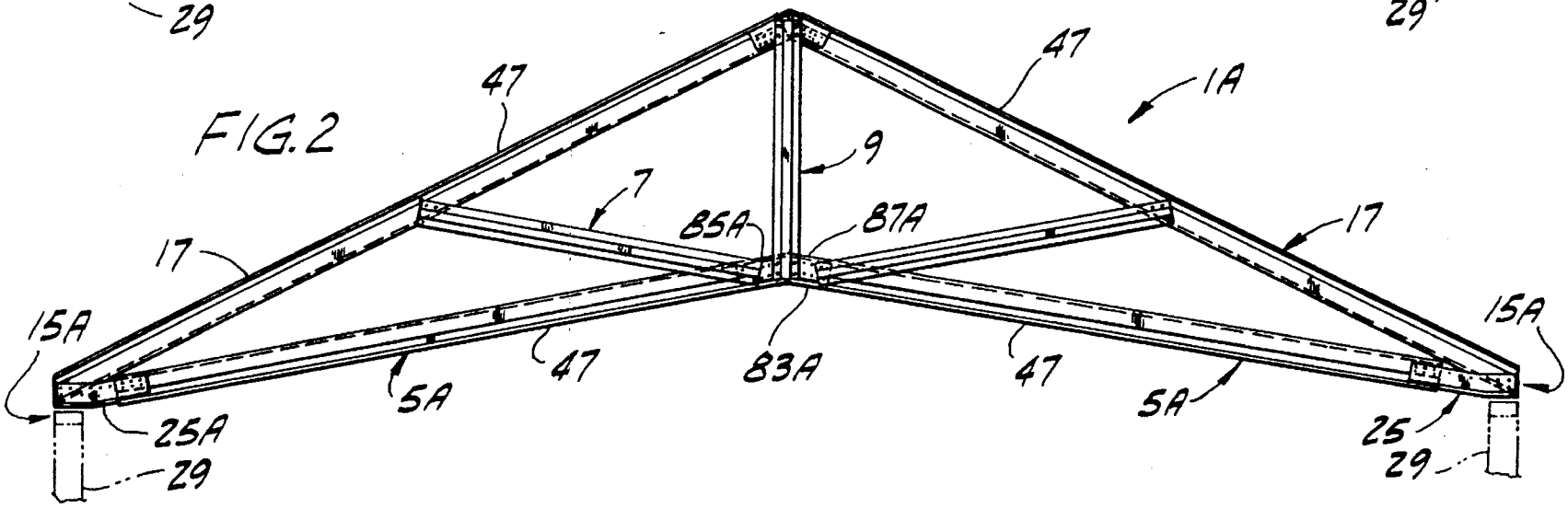
FIG. 2 is a view in side elevation of a scissors truss of this invention.
Figure 12:
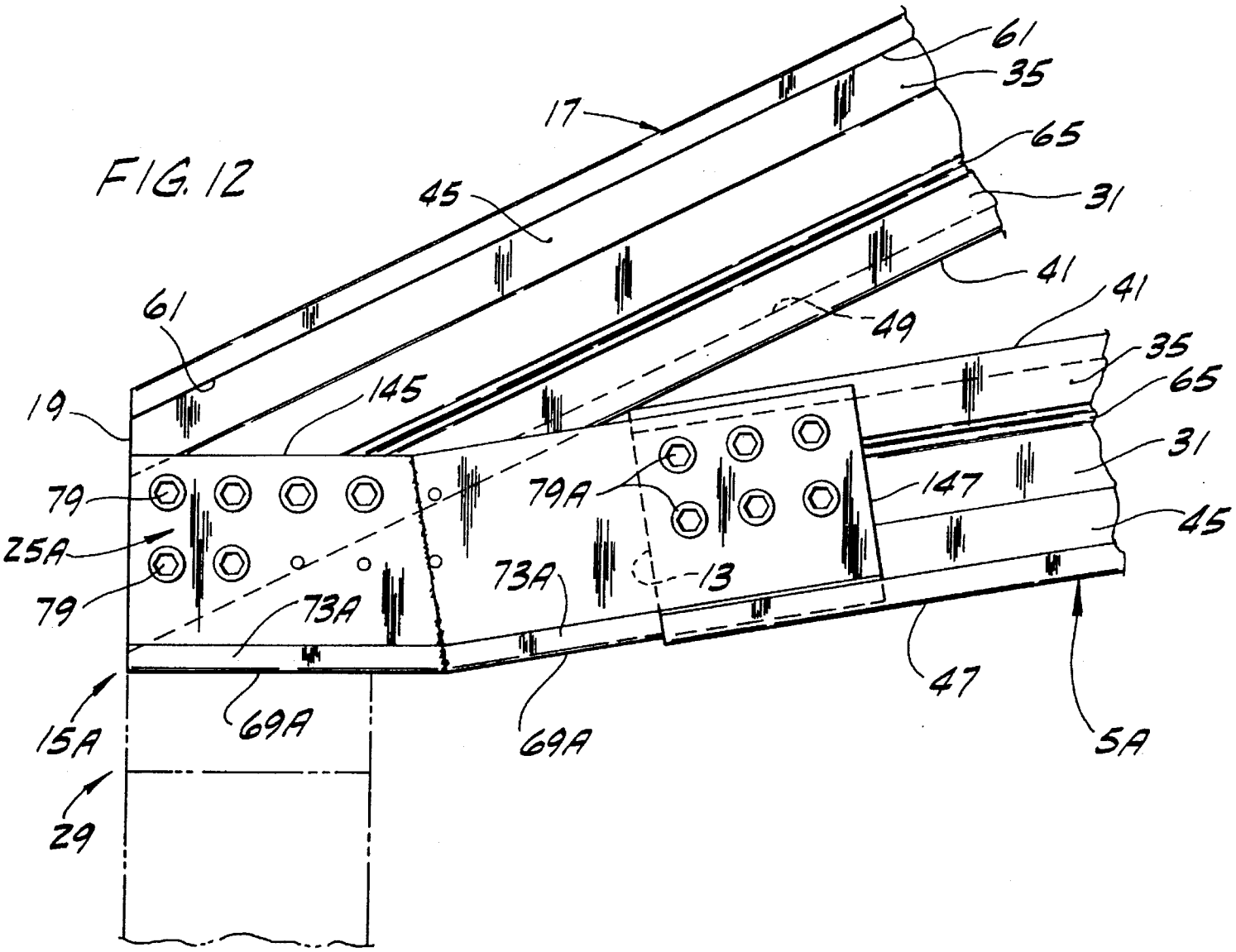
FIG. 12 is an enlarged fragment of FIG. 2 showing one of the heels of the scissors truss.

Referring to FIG. 2, there is indicated at 1A a scissors truss made in accordance with this invention corresponding generally to the king-post truss 1 shown in FIG. 1 except that the lower chord is constituted of two chord members each designated 5A which are inclined upwardly and inwardly from the heels 15A of the truss toward the central plane of the truss. The two lower chord members 5A are interconnected at their inner ends by a chevron-shaped connector plate 83A as shown in FIG. 2 similar to the peak connector plate 83 except that the angled branches 85A and 87A of plate 83A are angled in correspondence with the inclination or pitch of the lower chord members 5A. The connector plates at the heels 15A of the truss 1A are designated 25A (see FIGS. 2 and 12), and are similar to the heel connector plates 25 of the king-post truss of FIG. 1 except for having a first branch 145 which extends horizontally with regard to the truss as erected and a second branch 147 inclined upwardly With respect to the first branch 145 at an angle corresponding to the angle of inclination or pitch of the lower chord member 5A. This is needed to have the head 47 of the lower chord member 5 engage the inside of the flange 69A of the connector plate and to have the lip 73A on the flange engage the inside of the lip 61 on the head 47 of the lower chord member. The screw fasteners at the heels are again indicated at 79 and 79A.

The self-tapping screws used in fabricating the truss are shorter in length than the width of the flanges 41 and 53 on the web 31. Accordingly, the tips of the self-tapping screws even when fully driven home lie short of the plane of the outer faces of the lip 49 and narrow web 45 of the chord members. With this construction, it is possible to fabricate the truss on top of a fabrication table by laying the truss members on the table with the lip 49 and the web 45 of each member down in flatwise engagement with the table top, placing the connector plates in position for attachment to the chord members on the faces 35 (which face upwardly) of the chord members, entering the screws in the holes therefor in the plates, and driving the screws down without penetration of the screws into the table top. As noted above, the plates act as connectors and stiffeners at the joints, the flange and lip on the heel plate 25, and the flanges and lips on the peak plate and lower chord plate functioning to stiffen the plates and back up the heads and lips on the heads of the chord members at the joints. It is to be understood that the plates and web members may be secured to the chord members by a suitable adhesive or by welding instead of by screws, and in all cases the securing means may be applied from only one side of the truss.

Figure 11:
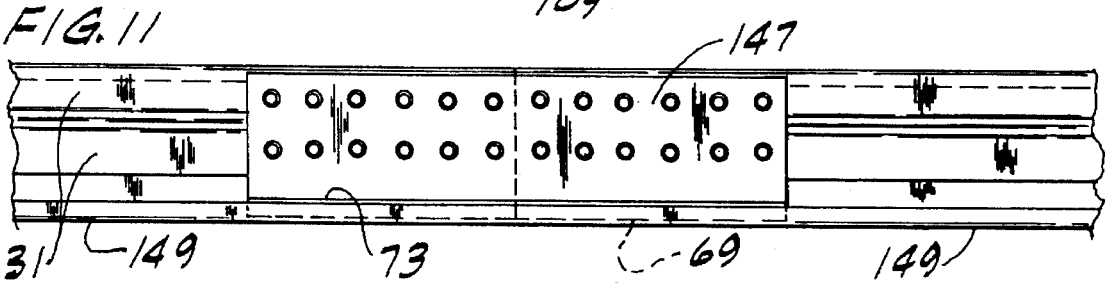
FIG. 11 is a view showing how two chord members may be connected in line end-to-end.

Joints such as illustrated at the peak 23 of the FIG. 1 king-post truss and for the inner ends of the lower chord members of the FIG. 2 scissors truss may be utilized for connecting two chord members having the FIG. 5A cross-section where the chord members have adjacent ends at the joint and where the chord members are angled one with respect to the other (as at the peak of the FIG. 1 truss, at the peak of the FIG. 2 truss, and at the center of the lower chord of the FIG. 2 truss). Also, a similar joint construction may be used where it is desired to have two lengths of chord member stock secured together end-to-end as shown in FIG. 11, by using a connector plate 147 of rectangular shape with a cross-section like that shown in FIG. 6 fastened at end portions thereof to the webs 31 of the two aligned and coplanar chord members 149.

Figure 13:
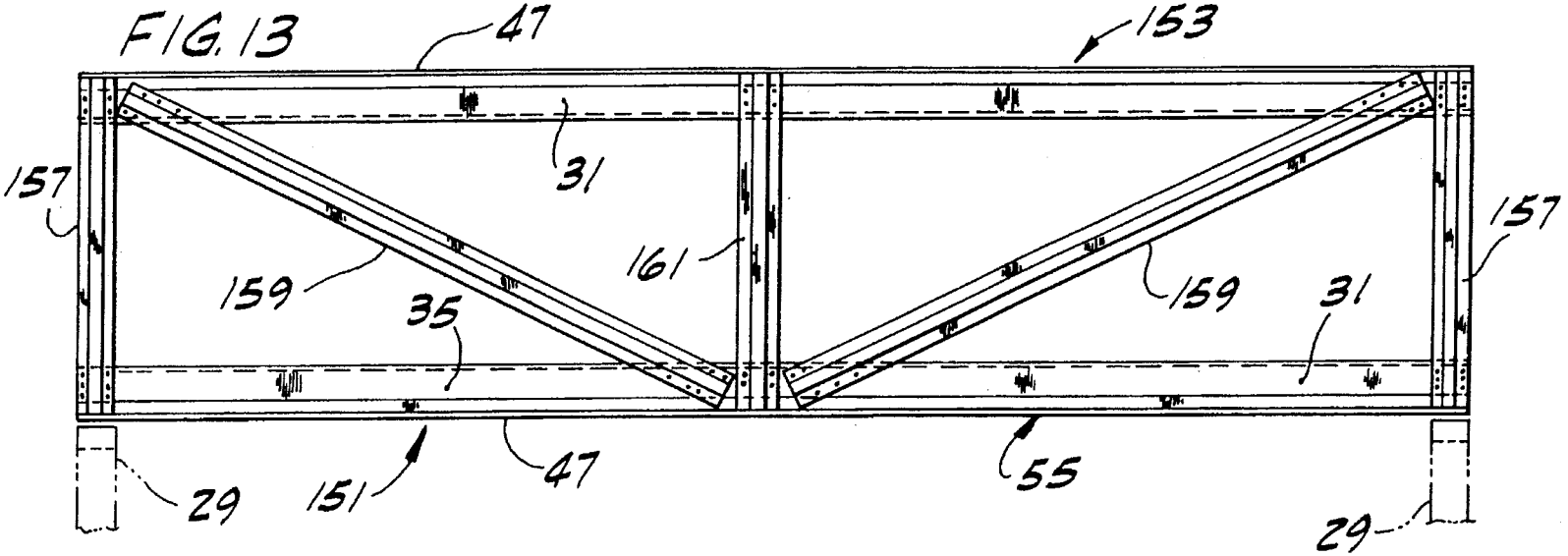
FIG. 13 is a view in side elevation of a truss having parallel upper and lower chords embodying the invention.

It is to be understood that the chord, web and connector and stiffener members may be used to fabricate not only roof trusses but also floor trusses where the chord members are parallel and the web members serve as struts, or other flat trusses. FIG. 13 shows a truss 151 with parallel upper and lower chord members 153 and 155 each having the cross-sectional shape of FIG. 6 and arranged with the head 47 of the upper chord member up, with the head of the lower chord member down, and with the webs 31 of the upper and lower chord members generally coplanar. Web members 157, 159 and 161 having the same cross-sectional shape as shown in FIG. 7 extend between and triangulate the space between the two parallel chords. Web members 157 extend vertically at the ends of the truss and constitute end chords having their upper ends engaging the lower face of the head 47 of the upper chord and their lower ends engaging the upper face of the head 47 of the lower chord. Web members 159 are inclined upwardly from adjacent the midpoint of the lower chord to adjacent the ends of the upper chord. Web member 161 extends vertically centrally of the truss. The heads 47 of the lower chord bear on supports 29 at the ends of the lower chord where web members 157 back up the heads.

Figure 14:
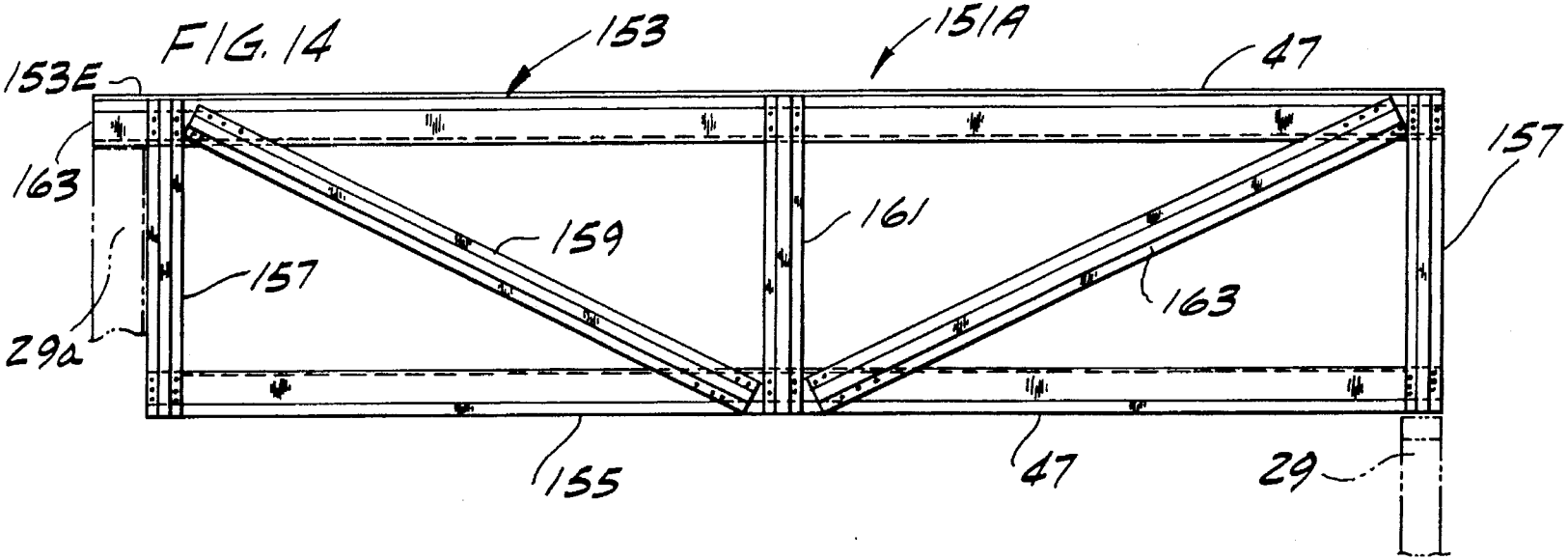
FIG. 14 is a view in side elevation of a truss similar to that shown in FIG. 13 but with the upper chord projecting at one end (the left end as shown) beyond the respective end of the lower chord.

FIG. 14 shows a truss 151A similar to the FIG. 13 truss except that the upper chord 153 projects at one end (its left end as shown) as indicated at 153E beyond the respective end of the lower chord 155, i.e., it projects beyond the vertical transverse plane of the respective end of the lower chord. The web members of the FIG. 14 truss are the same as the web members 157, 159 and 161 of the FIG. 13 truss. The projecting end 153E of the upper chord bears on an elevated support 29A; the right end of the lower chord bears on a support 29 the same as in FIG. 13. The projecting end 153E is reinforced and stiffened by a flanged plate indicated at 163 in FIGS. 14 and 16 having the same shape in cross-section as the plate 67 shown in FIG. 6. The plate 163 is fastened to the web 31 of the upper chord 153 outward of the upper end of the left-hand web member 157 as by self-tapping screws with the flange 69 of the plate at the bottom generally coplanar with the flange 41 of the upper chord. This provides broadened area bearing on the support 29A; generally corresponding to the area of the head 47 of the lower chord bearing on support 29.

FIG. 15 shows a truss 171 which may be referred to as an inverted parallel-chord truss having parallel upper and lower chord members 173 and 175 each having the cross-sectional shape of FIG. 5A arranged with the head 47 of the upper chord member up, with the head 47 of .the lower chord down, and with the webs 31 of the upper and lower chord members generally coplanar. Web-members 177 having the same cross-sectional shape as shown in FIG. 7 extend between and triangulate the space between the two parallel chords.

The upper chord is longer than the lower chord and projects at both ends beyond the ends of the lower chord as indicated at 173E, i.e., it projects at both ends beyond the vertical transverse planes of the ends of the lower chord. The end web members 177 are inclined upward and outward from the ends of the lower chord to adjacent the ends 173E of the upper chord, these ends 173E extending out past the upper ends of the end web members 177. The web members used between the end web members may be arranged in any of well-known suitable arrangements for triangulating the space bounded by the upper and lower chords and the end web members 177. The projecting ends 173E of the upper chord bear on supports 29B. Each projecting end 173E of the upper chord 173 is reinforced and stiffened by a plate 163 the same as used for the left end of the upper chord of the truss shown in FIG. 14.

Figure 17:
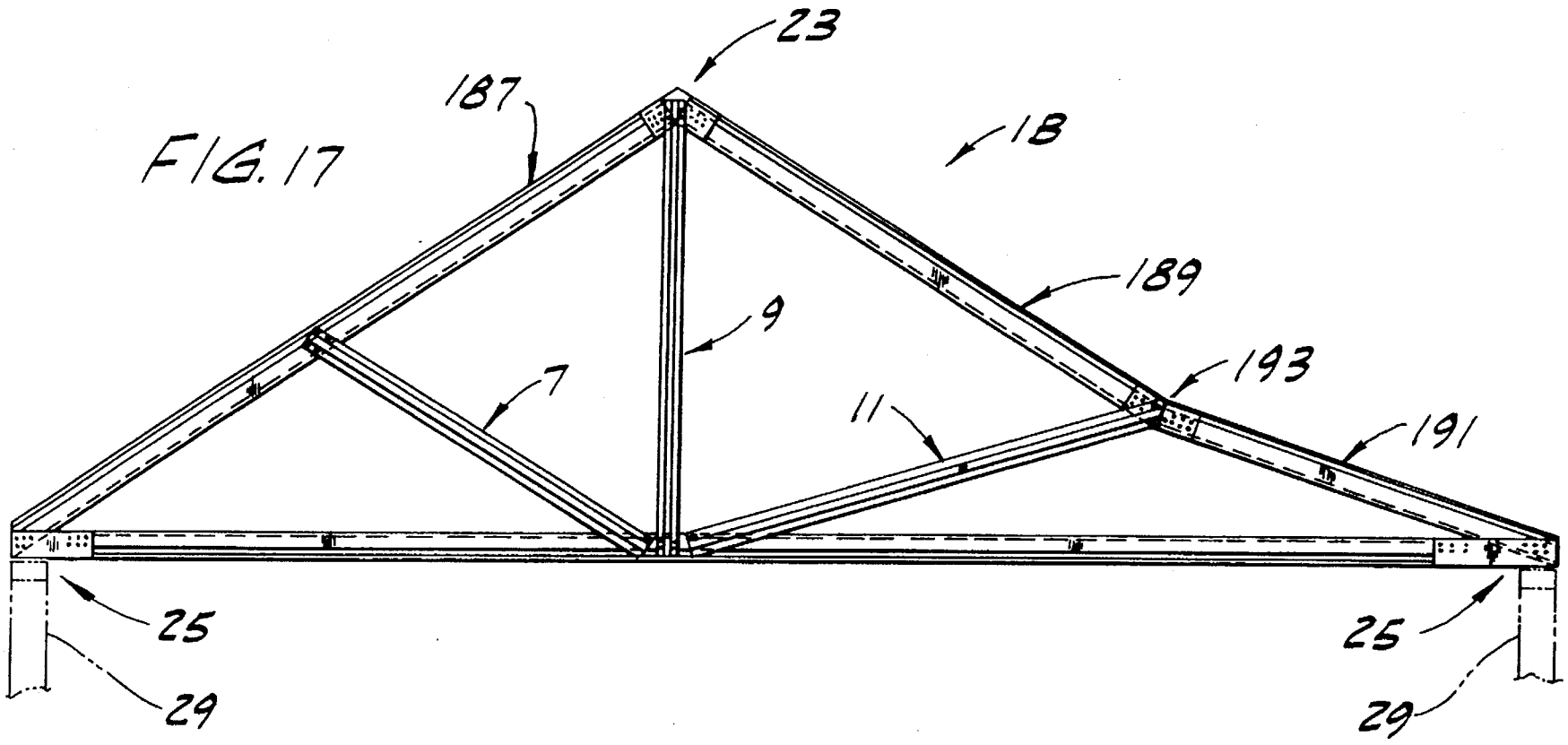
FIG. 17 is a view in side elevation of a gable truss embodying the invention, similar to the FIG. 1 truss but having a modification of the upper chord.

FIG. 17 shows a gable truss designated 1B similar to the truss shown in FIG. 1 except that the upper chord comprises three elongate straight chord members designated 187, 189 and 197, member 187 corresponding generally to the left-hand upper chord member 17 of the truss 1 shown in FIG. 1, and the members 189 and 191 are angled relative to one another. Member 191 extends from the right-hand heel of the truss to a joint at 193 with member 189 and the latter extends from this joint to the peak 23 of the truss. The joints at the heels and peak of the truss are essentially the same as at the truss heels and peak as shown in FIGS. 3 and 4, and the joint at 193 may be similar to the joint at the peak.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

What is claimed is:

1. A truss comprising an upper chord, a lower chord and a plurality of web members extending between said chords, the upper chord comprising at least one elongate member formed of sheet metal with such a shape in cross-section as to have a web having first and second opposite faces in a generally vertical plane and first and second longitudinal edges, a first flange extending laterally outwardly from the first face of the web at the first longitudinal edge of the web, a formation integrally joined to the web at the second longitudinal edge of the web having a portion offset laterally outwardly from the first face of the web and a generally flat portion extending back over said second edge constituting a head for said elongate chord member, said head extending generally at right angles to the plane of the web, having portions on both sides of the plane of the web, and adapted to serve as a support for means which is subsequently applied to the truss, the lower chord comprising at least one elongate chord member formed of sheet metal with the same shape in cross-section as the upper chord member, the upper chord member and the lower chord member being arranged with the head of the upper chord member up, with the head of the lower chord member down, and with the webs of the upper and lower chord members generally coplanar, the web members being constituted by elongate members formed of sheet metal, said plurality of web members having upper and lower ends overlapped in flatwise relation with respect to said faces of the webs of the upper and lower chord members and secured thereto.

2. A truss as set forth in claim 1 wherein the head of each chord member is spaced outwardly from said second edge.

3. A truss as set forth in claim 2 wherein said first flange of each chord member extends laterally outwardly from the first face of the web of the chord member and said formation comprises a second flange on the web extending laterally outwardly from said first face of the web at the second longitudinal edge of the web generally at right angles to the web, said second flange having an outer edge, and a relatively narrow web extending from the outer edge of said second flange generally at right angles to the second flange, said narrow web having an outer edge, the head extending laterally from the outer edge of the narrow web and integrally joined to the latter; said web members having their ends overlapped in flatwise relation with respect to second faces of the webs of the chord members.

4. A truss as set forth in claim 1 wherein said web members have such a shape in cross-section as to comprise a channel having a web and flanges at opposite sides of the web and coplanar flat portions extending laterally outwardly from the outer edges of the channel, said flat portions at the ends of said web members being overlapped in flatwise relation with respect to said faces of the webs of the upper and lower chord members and secured thereto.

5. A truss as set forth in claim 1 wherein said web members have such a shape in cross section as to comprise a central channel having a web and flanges at opposite sides of the web, said central channel opening in one direction, and side channels on opposite sides of the central channel each opening oppositely to the central channel, each side channel having a web integrally joined to a respective flange of the central channel at the edge of that flange outward of the web of the central channel, and an outer flange spaced outwardly from the respective flange of the central channel, the webs of the side channels being generally coplanar, the webs of the side channels of said web members being overlapped in flatwise relation with respect to said faces of the webs of the chord members.

6. A truss as set forth in claim 4 wherein said first flange of each chord member extends laterally outwardly from the first face of the web of the chord member and said formation comprises a second flange on the web extending laterally outwardly from said first face of the web at the second longitudinal edge of the web generally at right angles to the web, said second flange having an outer edge, and a relatively narrow web extending from the outer edge of said second flange generally at right angles to the second flange, said narrow web having an outer edge, the head extending laterally from the outer edge of the narrow web and integrally joined to the latter, the said flat portions of the web members at the ends thereof being overlapped in flatwise relation with respect to the second faces of the webs of the upper and lower chord members.

7. A truss as set forth in claim 1 wherein the lower chord has outer ends, the upper chord comprises elongate chord members each having a first end constituting its lower and outer end and a second end constituting its upper and peak end, the upper chord members being arranged with their lower and outer ends adjacent the outer ends of the lower chord and being inclined upwardly with their upper ends adjacent one another to form a peak of the truss, means interconnecting the upper chord members at their lower and outer ends to the lower chord at the outer ends of the lower chord to form a heels of the truss, and means interconnecting the upper chord members at their upper ends at the peak of the truss, the means interconnecting the upper chord members and the lower chord at each heel of the truss comprising a plate engaged flatwise with said face of the webs of the upper and lower chord members and fastened to the webs, the means interconnecting the upper chord members at the peak of the truss comprising a plate engaged flatwise with said face of the webs of the two upper chord members and fastened to the webs.

8. A truss as set forth in claim 7 wherein said first flange of each chord member extends laterally outwardly from the first face of the web of the chord member and said formation comprises a second flange on the web extending laterally outwardly from said first face of the web at the second longitudinal edge of the web generally at right angles to the web and a relatively narrow web, said second flange having an outer edge, extending from the outer edge of said second flange generally at right angles to the second flange, said narrow web having an outer edge, the head extending laterally from the outer edge of the narrow web and integrally joined to the latter; and wherein said plates are engaged flatwise with said second faces of the webs of the respective chord members.

9. A truss as set forth in claim 7 wherein the head of each chord member is spaced outwardly from said second edge.

10. A truss as set forth in claim 7 wherein the head is spaced outwardly from said second edge and each of the plates at the heels of the truss extends down beyond the web of the lower chord member into engagement with the inside of the head of the lower chord member.

11. A truss as set forth in claim 10 wherein each of the plates at the heels of the truss has an outwardly extending flange at its lower edge engaging the inside of the head of the lower chord member.

12. A truss as set forth in claim 11 wherein the head of each chord member has a lip at its free edge extending in the direction back toward the plane of the first flange and the flange of each of the plates at the heels of the truss has a lip on the inside of the lip of the head of the lower chord member.

13. A truss as set forth in claim 12 wherein the plates at the heels of the truss are fastened to the webs of the upper chord member and the lower chord member at the heels on the said second faces of the webs by self-tapping screws.

14. A truss as set forth in claim 13 wherein the plates have pre-formed holes for the screws and the screws are driven into the webs of the chord members at the heels of the truss.

15. A truss as set forth in claim 7 wherein the plate which interconnects the two upper chord members at the peak of the truss extends up beyond the webs of said upper chord members into engagement with the inside of the heads of the upper chord members.

16. A truss as set forth in claim 15 wherein the plate at the peak of the truss has an outwardly extending flange at its upper edge engaging the inside of the heads of the upper chord members.

17. A truss as set forth in claim 16 wherein the head of each of the upper chord members has a lip at its free edge extending down in the direction back toward the plane of the first flange and the flange of the plate has a lip on the inside of the lips of the heads of the upper chord members.

18. A truss as set forth in claim 17 wherein the plate at the peak of the truss is fastened to the webs of the upper chord members by self-tapping screws.

19. A truss as set forth in claim 18 wherein the plate at the peak of the truss has pre-formed holes for the screws and the screws are driven into the webs of the upper chord members.

20. A truss as set forth in claim 17 wherein the plate at the peak of the truss comprises a plate member having first and second coplanar flat portions angled downwardly away from one another, said portions having upper edges angled downwardly and away from one another at an angle corresponding to the inclination of the upper chord members, said flat portions being engaged flatwise with the second faces of the webs of the two upper chord members at the peak of the truss and fastened to these webs, said plate having flanges extending out from said inclined edges engaging the inside of the heads of the upper chord members and the flanges of said plate having lips extending downwardly therefrom at their outer edges on the inside of the lips of the heads of the upper chord members.

21. A truss as set forth in claim 1 wherein the upper chord and lower chord are parallel.

22. A truss as set forth in claim 21 wherein the head of each chord member is spaced outwardly from said second edge.

23. A truss as set forth in claim 22 wherein said first flange of each chord member extends laterally outwardly from the first face of the web of the chord member and said formation comprises a second flange on the web extending laterally outwardly from said first face of the web at the second longitudinal edge of the web generally at right angles to the web, said second flange having an outer edge, and a relatively narrow web extending from the outer edge of said second flange generally at right angles to the second flange, said narrow web having an outer edge, the head extending laterally from the outer edge of the narrow web and integrally joined to the latter; said web members having their ends overlapped in flatwise relation with respect to said second faces of the webs of the chord members.

24. A truss as set forth in claim 21 wherein said web members have such a shape in cross-section as to comprise a channel having a web and flanges at opposite sides of the web and coplanar flat portions extending laterally outwardly from the outer edge of the channel, said flat portions at the ends of said web members being overlapped in flatwise with respect to said faces of the webs of the upper and lower chord members and secured thereto.

25. A truss as set forth in claim 21 wherein said web members have such a shape in cross section as to comprise a channel having a web and flanges at opposite sides of the web, said central channel opening in one direction, and side channels on opposite sides of the central channel each opening oppositely to the central channel, each side channel having a web integrally joined to a respective flange of the central channel at the edge of that flange outward of the web of the central channel, and an outer flange spaced outwardly from the respective flange of the central channel, the webs of the side channels being generally coplanar, the webs of the side channels of said at the end web members being overlapped in flatwise relation with respect to said faces of the webs of the chord members.

26. A truss as set forth in claim 24 wherein said first flange of each chord member extends laterally outwardly from the first face of the web of the chord member and said formation comprises a second flange on the web extending laterally outwardly from said first face of the web at the second longitudinal edge of the web generally at right angles to the web, said second flange having an outer edge, and a relatively narrow web extending from the outer edge of said second flange generally at right angles to the second flange, said narrow web having an outer edge, the head extending laterally from the outer edge of the narrow web and integrally joined to the latter, the said flat portions of the web members at the ends thereof being overlapped in flatwise relation with respect to the second faces of the webs of the upper and lower chord members.

27. A truss as set forth in claim 26 wherein said upper chord member has at least at one end projects beyond the respective end of the lower chord and has a first plate engaged flatwise with and secured to the said second face of the web at said end, said first plate extending down to the lower edge of the web and having a lower edge end a flange extending laterally outwardly at its lower edge opposite to and generally coplanar with the first-named flange of the upper chord member.

28. A truss as set forth in claim 27 wherein the upper chord member has its other end projecting beyond the other end of the lower chord and has a second plate engaged flatwise with and secured to said second face of the web at said other end said second plate extending down to the lower edge of the web, said second plate having a flange extending laterally outwardly at its lower edge opposite to and generally coplanar with the first flange of the upper chord member.

29. A truss having two chord members meeting at a joint, each chord member being an elongate sheet metal member formed of sheet metal with such shape in cross-section as to have a web having first and second opposite faces and first and second longitudinal edges, a first flange extending laterally outwardly from the first face of the web at the first longitudinal edge of the web, a formation integrally joined to the web at the second of the longitudinal edges of the web having a portion offset laterally outwardly from said first face of the web and a generally flat portion extending back over said second edge constituting a head for said elongate chord member, said head extending generally at right angles to the plane of the web, said formation comprising a second flange on the web extending laterally outwardly from the first face of the web at the second longitudinal edge of the web generally at right angles to the web and a relatively narrow web extending from the outer edge of said second flange in the direction away from the first flange generally at right angles to the second flange, the head extending laterally from the outer edge of the narrow web and integrally joined to the latter, said chord members having their webs coplanar and the first faces of their webs facing in one direction and the second faces of the webs facing in the opposite direction, and a plate engaged flatwise with the second faces of the webs and fastened to these webs, said plate extending beyond the webs into engagement with the inside of the heads and having a flange extending laterally therefrom at its outer edge in engagement with the inside of the heads of the chord members, each said head having a face edge and a lip at its free edge, said flange of said plate having a lip on the inside of the lips of the heads of the chord members.

30. A truss as set forth in claim 29 wherein the chord members are angled one with respect to the other, and the plate has branches angled in accordance with the angling of the chord members.

31. A truss as set forth in claim 29 wherein the chord members are arranged end-to-end.

32. A structural member, said member being an elongate sheet metal member formed with such a shape in cross-section as to have a generally flat first web having first and second opposite faces and first and second longitudinal edges, a first flange extending in generally vertical plane laterally outwardly from the first web at the first longitudinal edge of the first web generally at right angles to the first web in the direction away from the first face of the first web, a second flange extending laterally outwardly from the first web at the second longitudinal edge of the web generally at right angles to the first web in the same direction as the first flange, said flanges generally being of the same width, and each having an outer edge, a second web having a width less than that of the first web extending from the outer edge of the second flange in a plane generally parallel to that of the first web and in the direction away from the first flange, said second web having an outer edge, and a generally flat head extending form the outer edge of the second web generally at right angles thereto in the direction back toward the plane of the first web and of such width as to extend past the plane of the first web, said head having portions on opposite sides of the plane of the first web and an outer edge on the opposite side of the plane of the first web from the second web.

33. A structural member as set forth in claim 32 wherein the head is spaced outwardly from the second flange.

34. A structural member as set forth in claim 33 wherein the first flange has a reentrant lip at its outer edge.

35. A structural member as set forth in claim 34 wherein the head has a reentrant lip at its outer edge.

36. A structural member as set forth in claim 35 having a neutral axis generally parallel to and adjacent the said first face of the first web.

* * * * *

UNITED STATES PATENT AND TRADEMARK OFFICE

CERTIFICATE OF CORRECTION

PATENT NO. : 5,457,927

DATED : October 17, 1995

INVENTOR(S) : Michael A. Pellock et al.

It is certified that error appears in the above-identified patent and that said Letters Patent is hereby corrected as shown below:

On the title page: Item [73], add the co-assignee Dietrich Industries, Inc., Pittsburgh, Pennsylvania.

Signed and Sealed this

Twenty-third Day of July, 1996

*Attest:*

*Attesting Officer*

BRUCE LEHMAN

*Commissioner of Patents and Trademarks*